United States Patent [19]

Miller et al.

[11] Patent Number: 4,532,743

[45] Date of Patent: Aug. 6, 1985

[54] SLIDING DOOR ASSEMBLY

[76] Inventors: Alexander Miller; James E. Sweetman; Douglas J. McDougall, all of 16295 NW. 13 Ave., Miami, Fla. 33169

[21] Appl. No.: 462,616

[22] Filed: Jan. 31, 1983

[51] Int. Cl.[3] ..... E06B 1/04

[52] U.S. Cl. ..... 52/207; 49/458; 49/449; 292/304

[58] Field of Search ..... 49/207, 425, 449, 406, 49/458; 292/DIG. 46, 304, 202; 52/207

[56] References Cited

U.S. PATENT DOCUMENTS

| | | | |
|---|---|---|---|
| 1,833,254 | 11/1931 | Linder | 292/202 |
| 2,118,729 | 7/1936 | Hogan | 292/DIG. 46 |
| 2,913,046 | 11/1959 | Sharp et al. | 49/425 |
| 2,950,756 | 8/1960 | Moloney | 49/449 |
| 3,267,613 | 8/1966 | McQuiston | 49/449 |
| 3,623,269 | 9/1969 | Algrain | 52/207 |
| 4,170,885 | 10/1979 | Lundgren | 49/449 |
| 4,190,272 | 2/1980 | Beard | 292/DIG. 46 X |
| 4,202,137 | 5/1980 | Randall | 49/458 |
| 4,395,847 | 8/1983 | Atchison | 49/406 |
| 4,398,373 | 8/1983 | Mancuso | 49/458 X |

*Primary Examiner*—Henry E. Raduazo
*Assistant Examiner*—Creighton Smith
*Attorney, Agent, or Firm*—John Cyril Malloy

[57] ABSTRACT

A sliding door assembly of the type at least partially formed from extruded material components wherein the assembly includes at least one movable panel and one stationary or fixed panel. The door assembly includes a lock assembly structured and positioned to be interconnected between portions of the two panels to prevent relative movement therebetween. Both of the panels are supported on a track assembly incorporating various components including a removable, snap-in threshold and a similarly removable track runner for support of the movable panels thereon.

7 Claims, 15 Drawing Figures

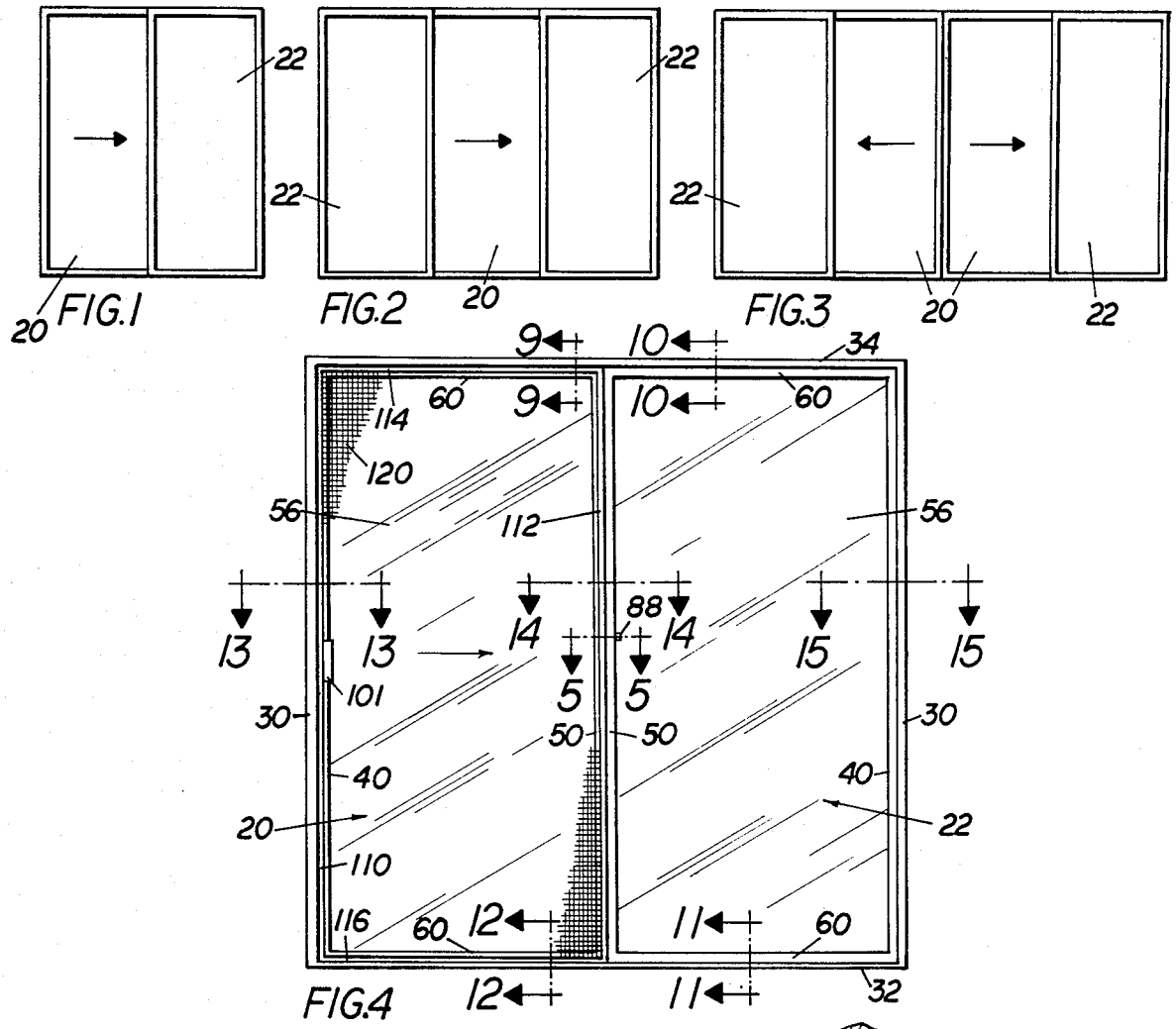
22
22
20
FIG.1
22
22
20
FIG.2
22
22
20
22
FIG.3
9
10
34
114
60
9
10
60
120
56
112
56
13
13
14
88
14
15
15
101
5
5
30
50
50
30
40
40
20
22
110
116
60
12
11
60
FIG.4
12
11
32
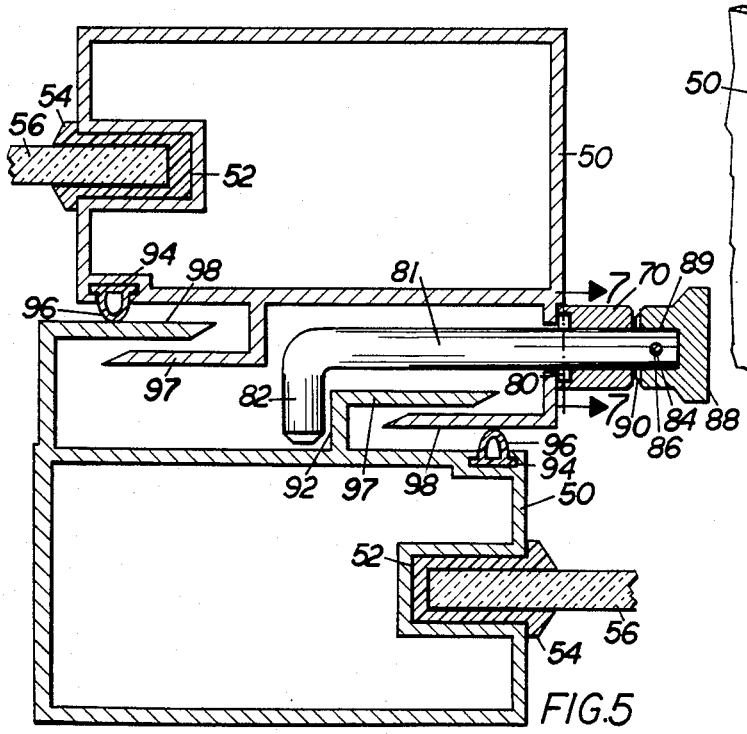
54
56
52
50
94
98
81
7
70
89
96
97
82
80
7
90
84
88
86
96
94
92
97
98
50
52
56
54
FIG.5
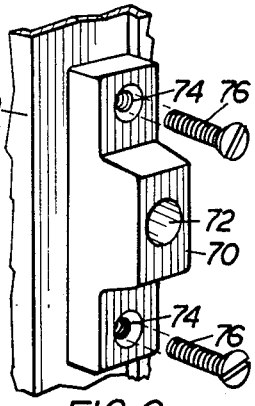
50
74
76
72
70
74
76
FIG.6
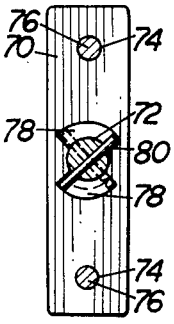
76
70
74
72
78
80
78
74
76
FIG.7
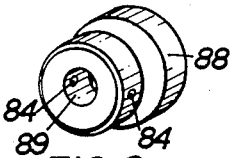
88
84
89
84
FIG.8

SLIDING DOOR ASSEMBLY

BACKGROUND OF THE INVENTION

1. Field of the Invention

The present invention is directed to a sliding door assembly of the type including at least one stationary and one movable panel wherein the panels are generally formed from a tempered glass plate and are positioned across a doorway through which access is readily provided by selective positioning of the movable panel relative to the fixed or stationary panel.

2. Description of the Prior Art

Sliding doors which generally include one or more glass panels being slidable along a track assembly relative to one or more fixed panels have been known in the prior art for many years. Such door assemblies are quite popular in that frequently the individual panels are made up of tempered glass sheets which allow a clear view of the exterior through the various panels while at the same time providing ready access into and out of a given dwelling or building in which the door assembly is mounted. Such structures, which are now commercially available, include the various stationary and/or movable panels surrounded by a supporting frame of extruded aluminum or like rigid material. The movable panel is generally slidable or movable relative to a fixed panel along a track assembly wherein the movable panel is supported either from the top header or on the bottom track assembly itself by some type of slide or roller assembly. Frequently, in addition to the peripheral borders or frames surrounding the individual panel, the door jambs including header and supporter base rail portions are also formed from extruder material. Such material is specifically configured and structured for attachement and for support of the panels as desired.

While such sliding door assemblies have enjoyed a great degree of popularity they have also encountered various problems which are generally well recognized both by the consuming public and by the industry at large.

Such problems include the area of security. It is generally recognized that such sliding doors are relatively easy to open for the purpose of accomplishing unauthorized entry. Also, it is sometimes found that the various panels, and particularly the movable panels slidable within the supporting frame or jamb of the assembly become dislodged from their track either through inadvertant removal of the roller assembly from a track runner or from dislodging of various guide components from an overhanging track or rail along which the movable panel slides.

In order to overcome the above set forth problems there is a recognized need in the industry for a sliding door assembly of the type aforementioned which includes numerous structural features generally intended to overcome the specific problems as set forth above and other common problems general to the manufacture and maintenance of sliding door assemblies.

Such a preferred sliding door assembly should include a lock assembly or structure which would greatly aid in the overcoming of any security problem. The support structural components used to maintain the movable panel as well as the stationary panel in their proper operative position should be designed and structured to accomplish support as well as positioning of the panels as intended. In addition, the frame or jamb structure of the assembly should include structural features capable of readily being adapted to the design of the dwelling in which doorway of the door assembly is mounted.

SUMMARY OF THE INVENTION

The present invention is directed to a door assembly of the type including one or more movable panels positionable and movable along a track assembly relative to one or more fixed or stationary panels. The panels are disposable between an open or closed position across a doorway thereby regulating access into and out of a given dwelling or structure. Generally, the closed position of the assembly is defined when the panels are arranged in an extended, side-by-side relation and completely cover the passage defining the doorway. In such position, of course, access is prevented through the doorway. The open position is defined by a movable panel being disposed in substantially overlapping relation to a fixed panel. This provides a clear opening through the doorway thereby allowing ready access therethrough.

The present invention includes at least one movable panel slidable along a track assembly relative to at least one stationary panel. The panels may be formed from tempered glass sheets along a major portion of the surface area thereof surrounded and supported by extruded material frames including side rails, top rails, and bottom rails.

Structural features of the invention include each panel including an interlocking side rail defined along at least one lateral longitudinal peripheral border of each panel. Each of the interlocking rails have substantially congruent cross-sectional configurations that are reversely oriented such that the mating portions of each interlocking rail are positionable into substantially mating, interlocking relation to one another when the panels are disposed in the closed position as set forth above.

In addition, a lock assembly having an elongated rod portion with a distal end of predetermined configuration is mounted adjacent one mating portion of one interlocking rail. The rod is structured and configured to extend therethrough into abutting, interlocking relation with the mating portion of the oppositely disposed interlocking rail.

Additional structural features of the present invention include the track assembly extending along and substantially defining the bottom peripheral portion of the frame of the door assembly. Both the stationary panel and the movable panel are supported on the track assembly wherein the movable panel includes a roller assembly. The roller assembly is specifically disposed and configured to move along an upper peripheral edge of a track runner. The track runner is preferably formed of a stainless steel or like rigid and strong material and is disposed along a predetermined length of the track assembly. The movable panel can be effectively supported thereon so as to move along relative to the fixed panel. In addition, the track runner includes depending flexibly structured and attached side wall portions which may be positioned for a snap-fit and removable attachment in its intended proper position in the track assembly. Such snap-fit allows the track runner to be readily removed and/or replaced when required.

Other structural features of the track assembly include a threshold portion which includes depending flexibly connected and structured finger elements. These finger elements are designed to be flexed relative to one another and to a permanently affixed channel of the track assembly in which the threshold portion is positioned. By virtue of this structure, the threshold may be snap-fitted into place and readily removed therefrom when desired. The threshold is also dimensioned and configured to effectively fill the channel portion of the extruded track assembly which would normally be occupied by a panel. The threshold is positioned as an extension of the side edge of the fixed or stationary panel.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature of the subject invention, reference should be had to the following detailed description taken in connection with the accompanying drawings, in which:

FIG. 1 is a front plan view of a door assembly comprising at least one movable panel and at least one fixed panel.

FIG. 2 is a front plan view of a door assembly incorporating at least one fixed panel movable between two spaced apart stationary panels disposed on either side of the movable panel.

FIG. 3 is a front plan view of two movable panels disposed in side-by-side relation to one another and movable in overlapping relation relative to two spaced apart stationary panels located at each end of the assembly.

FIG. 4 is a front plan view in detail of the embodiment of FIG. 1.

FIG. 5 is a sectional view taken along line 5—5 of FIG. 4 and showing structural details of the lock assembly of the present invention.

FIG. 6 is an isometric view of the mounting structure lock assembly of the present invention.

FIG. 7 is a sectional view along line 7—7 of FIG. 5.

FIG. 8 is an isometric view of the turning knob structure shown in sections in FIG. 5.

Similar reference characters refer to similar parts throughout the several views of the drawings.

DETAILED DESCRIPTION OF THE PREFERRED EMBODIMENT

Figure 9:
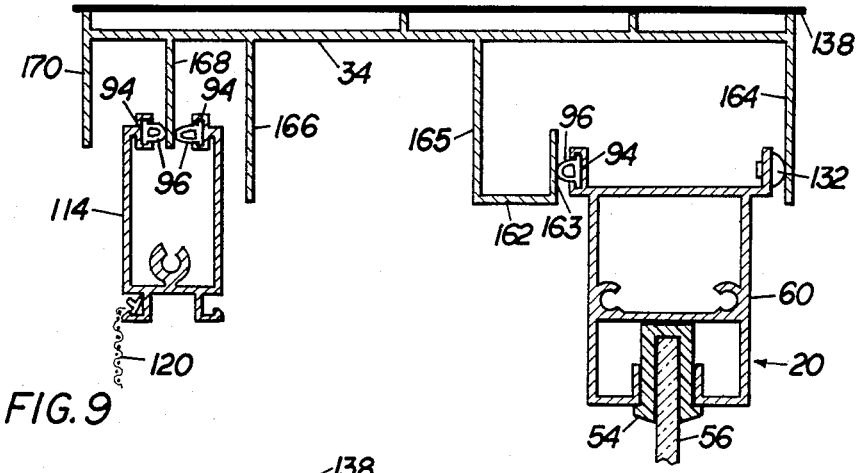
FIG. 9 is a sectional view taken along line 9—9 of FIG. 4.

As represented in FIGS. 1 through 3, the present invention is directed towards a door assembly which includes at least one moving panel 20 and at least one stationary panel 22. Obviously, various modifications of this arrangement can be utilized and still be within the intent and scope of the present invention. As shown in FIG. 2 there is involved a single movable panel 20 having spaced apart stationary panels 22 on either side thereof. Similarly in FIG. 3, movable panels 20 are located in side-by-side relation and designed to be opened into an overlapping relation with stationary panels 22 located at opposite ends of the door assembly.

Figure 10:
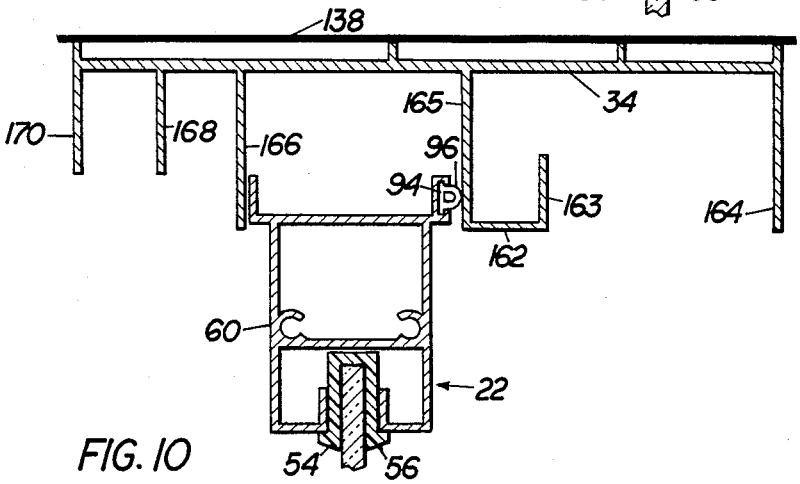
FIG. 10 is a sectional view taken along line 10—10 of FIG. 4.
Figure 11:
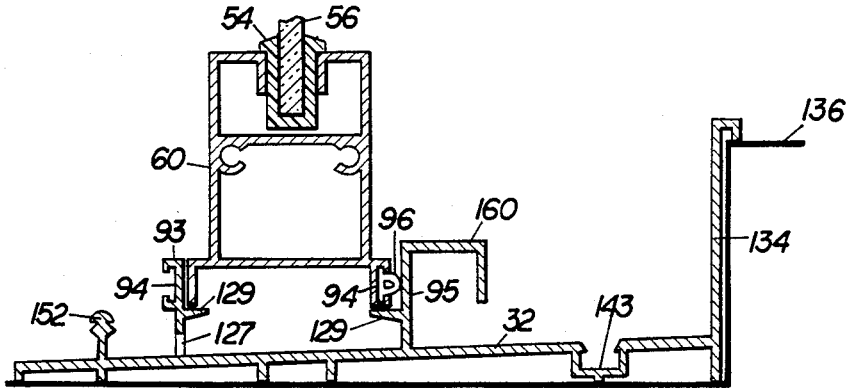
FIG. 11 is sectional view taken along line 11—11 of FIG. 4.

With reference to FIG. 4, specific structural details of the invention are better described. More specifically, movable panel 20 is located in cooperative relationship to stationary panel 22 in the aforementioned fashion. Further, a screen 120 having surrounding frame or rails as at top rail 114 and bottom rail 116 is also movable along a track assembly 32 (FIGS. 1, 10, and 11). It should further be noted that in describing the structural details of the present invention, both the surrounding frame of each panel as well as the surrounding frame of the screen 120 are formed from extruded material having integrally attached thereto various structural features to aid in the operation of the subject invention. In addition, the header 34, track assembly 32 and side jambs 30 are also formed from an extruded material and include the various structural components which will be more specifically set forth hereinafter.

With reference to FIGS. 4, 5, 6, 7 and 8, the subject invention includes a lock assembly which is specifically designed to be attached to a side rail portion of one of the panels and is so structured to interlockingly engage the oppositely positioned side rail of the opposite panel. As shown in FIG. 5, the movable panel 20 and the stationary panel 22 each include side rail portions 50 which may herein be termed interlocking rails. Interlocking rails 50 each include a substantially congruent or equivalent cross-sectional configuration that are oppositely or reversely oriented so as to be brought into mating engagement with one another. Further, each interlocking rail 50 has a mating portion primarily defined by spaced apart flanges 97 and 98 extending outwardly from the remainder of the interlocking rail 50 and disposed in a substantially parallel but staggered relation to one another. The reverse orientation of the interlocking rails, when brought into mating engagement, causes the oppositely disposed flanges 97 and 98 of the opposite interlocking rails to be brought into overlapping or interlocking engagement with one another.

Again with reference to the lock assembly (FIGS. 5 through 8), an elongated rod 81 is mounted on a support base 70 through aperture 72. The support base 70 is fixedly secured to one interlocking rail 50 by connecting screws 76 passing through threaded apertures 74. The locking rod 81 has a sufficient length to extend through the mating portion, between flanges 97 of both interlocking rails 52 which are attached. The distal end 82 thereof is configured to be positioned into locking engagement by being oriented in interruptive path with the outstanding flange base 92. This occurs due to the rotational mounting of the rod 81 within aperture 72 of the support base 70. Such rotational configuration is allowed in that a knob member 88 is secured to the free end 89 of the locking rod 81 and caused to rotate therewith through the existence of pin 84 passing through aperture 86. A biasing spring washer 90 is positioned in concentric relation about the rod 81 and between the mounting base 70 and the knob 88. This forces the rod into an outward desired position.

As best shown in FIG. 7, the mounting base 70 has on its undersurface thereof a stop member defined by indentations 78 receiving cross pin 80 therein. Due to the arcuate configuration and longitudinal dimension of each indentation 78, the pin which is secured through rod 81 is allowed to rotate only 90 degrees in opposite directions. Accordingly, twisting of the knob 88 positions the distal end 82 either into interruptive engagement with base 92 or out of such interruptive engagement. When in the position shown in FIG. 5, the rod 81 is of course in a locking position thereby preventing relative movement between the panel 20 and panel 22. In the preferred embodiment, the lock assembly is mounted on the interlocking rail 50 of the movable panel 20 and travels therewith. When brought into its closed relation, wherein interlocking rails 50 are disposed in overlapping relation to one another, the knob 88 may be rotated such that distal end 82 of rod 81 is in the position shown in FIG. 5. In such position, locking occurs and, as set forth above, relative movement between the two panels 20 and 22 is prevented. Details of the knob assembly 88 is shown in FIG. 8 wherein an aperture 89 houses the free end of rod 81 and the pin elements 84 passes through apertures 86 and through the rod as shown in FIG. 5.

For purposes of clarification, each panel 20 and 22 is represented as including as its main surface, a tempered glass sheet 56 attached within receiving channel 52 by a channel glazing vinyl 54. Connections of the sheets 56 to the header rails and base rails 60 are connected in the same fashion. Other structural features include weather stripping 96 mounted within receiving channel 94 and engaging the correspondingly positioned surface of the flange 98 of each interlocking rail 50.

Turning to FIGS. 9 through 12, a supporting ceiling or wall 138 has secured thereto the header 34 having surface flanges 170 and 164 generally disposed on the exterior and interior of the dwelling repectively in which the door assembly is mounted. In the embodiment shown in FIG. 9, panel 20 has its top rail 60 passing through a channel defined by the interior surface of flange 164 and surface 163 of depending component 162. Similarly, weather strips 96 slidingly engage surface 163. A bumper member 132 is secured to the upper portion of the top rail 60 and is disposed to engage the interior surface of flange 164 and maintain the top rail in the proper position. The screen 120 is secured along its upper portion to a top rail 114. Weather strips 96 embrace opposite surfaces of depending flange 168 which is integrally attached to the header 34. The screen 120 is attached along its upper periphery to appropriately disposed depending channels and connecting members as shown.

With reference to FIGS. 9 and 10, the stationary or fixed panel 22 is mounted within channels defined by interior surfaces 155 and the interior surface of depending flange 166. These depending flange portions are again integrally secured to the extruded header 34 which in turn is attached to the ceiling or appropriate wall surface 138. The header or top rails and base rails 60 of the stationary panel 22 is disposed in surrounding supporting relation to the tempered glass panel 56 as explained above. The undersurface or portion of the base rail 60 (FIG. 11) is secured to the interior surfaces of upwardly projecting flanges 93 and 95. Appropriately positioned weather strips 96 mounted in channels 94 are engaging the correspondingly positioned surfaces of the flange member 160. Further, support fingers 129 extend along the length and support the undersurface of the depending flanges of the undersurface of rail 60 as clearly shown in FIG. 10. Upstanding fixed rail 152 projects upwardly from the base of the track assembly 32 at a sufficient distance to support and have movable mounted thereon the roller assembly 150 of the screen 120. More specifically, the base or bottom rail 116 houses the roller assembly 150 which includes roller element 154. The upper peripheral, longitudinal edge of upstanding runner 152 engages the outer peripheral portion of roller 154 so as to allow the screen and in particular the base rail 116 to pass therealong. Weather stripping or sealing strips 93 mounted in channels 95 are positioned on opposite sides of the upstanding rail 152 as shown.

Figure 12:
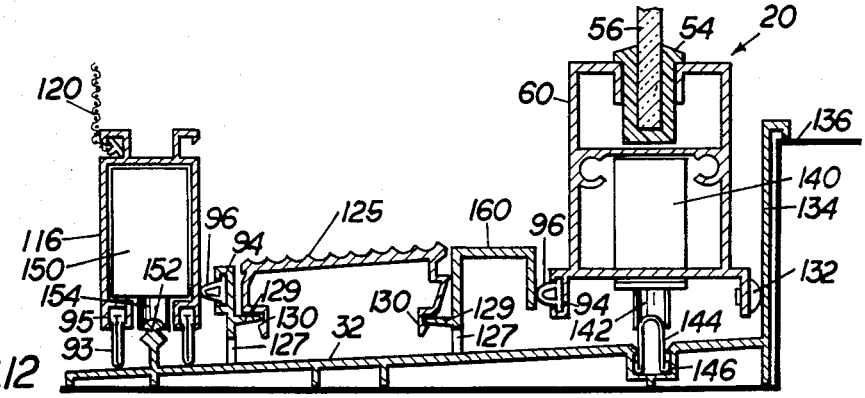
FIG. 12 is a sectional view taken along line 12—12 of FIG. 4.

Again with reference to FIGS. 11 and 12, the track assembly 32 includes a track runner 144 mounted within channel 143 and specifically projecting upwardly therefrom to engage the outer periphery of roller 142 which is associated with the roller assembly 140. This roller assembly 140 is mounted within the bottom rail 60 of the movable panel 20. It allows movement of panel 20 along the entire length of track runner 144 which extends along a predetermined length of the track assembly 32. It should be noted that the track runner 144 is specifically structured to allow a snap-fit connection within channel 143 thereby providing for its easy insertion and ready removal therefrom when required. This is accomplished by flexible depending side walls, spaced apart from one another and capable of being flexed toward and away from one another so as to fit within the channel 143 and be maintained therein. The portions 146 interengage the overhanging portions of the channel as best shown in FIGS. 11 and 12 so as to be locked therein and prevent inadvertent removal. A spacer element 132 engages the inner surface of upstanding track flange 134, the riser 136 which may form part of the dwelling in which the door assembly or doorway is mounted.

Other structural features as best shown in FIG. 12 include the provision of a threshold assembly 125 capable of being snap-fitted or snap-locked into a correspondingly positioned channel integrally secured or formed on the track assembly 32. More specifically, depending fingers 130 are integrally formed on the threshold portion 125 and extend along the length thereof. Due to their flexibility, they may be fit about the outstanding finger elements or flanges 129 which in turn fit into appropriately positioned grooves on the exterior surface of the fingers 130 as shown in FIG. 12. So positioned, the threshold 125 fills the gap generally provided by the absence of a panel within this panel. In that channel 22 is fixed it does not pass into this portion or extension of the channel and therefore the threshold 125 is required. The snap-fit or snap-lock connection facilitates easy insertion or removal of the threshold when the door assembly is being installed.

Figure 15:
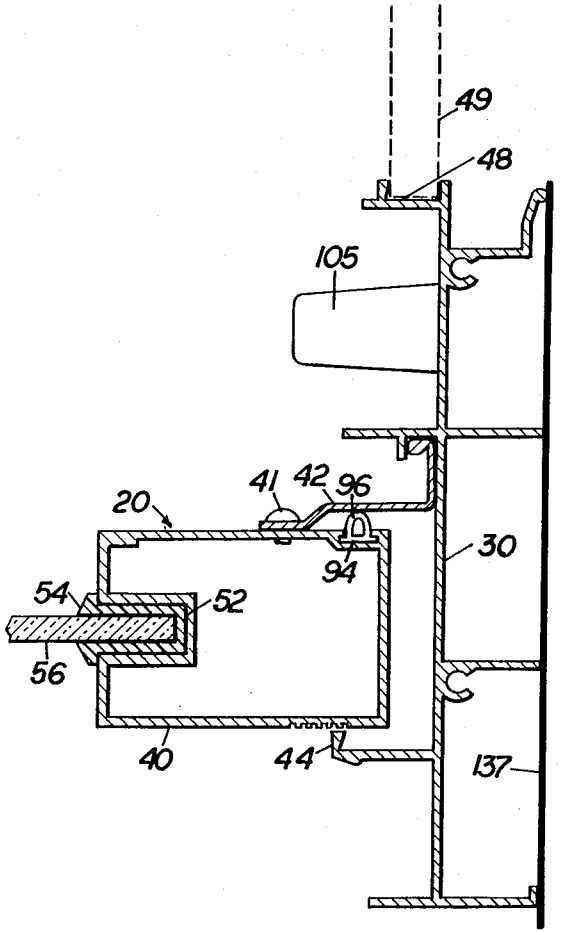
FIG. 15 is a sectional view taken along line 15—15 of FIG. 4.
Figure 14:
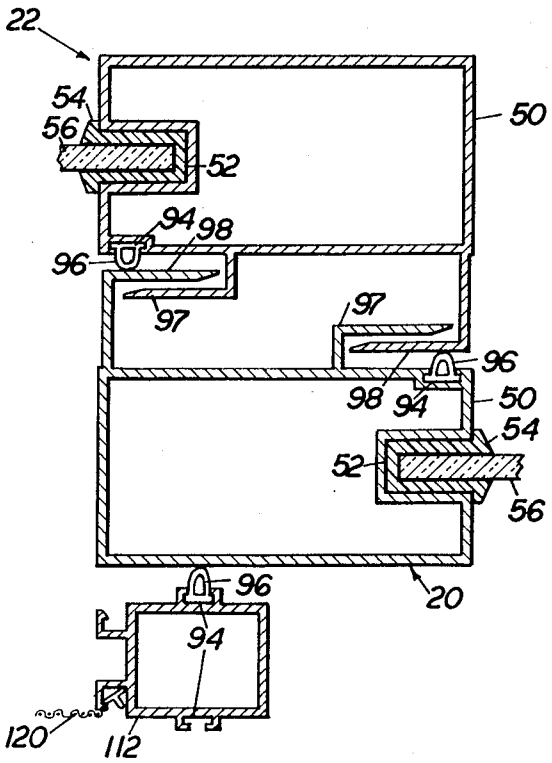
FIG. 14 is a sectional view taken along line 14—14 of FIG. 4.
Figure 13:
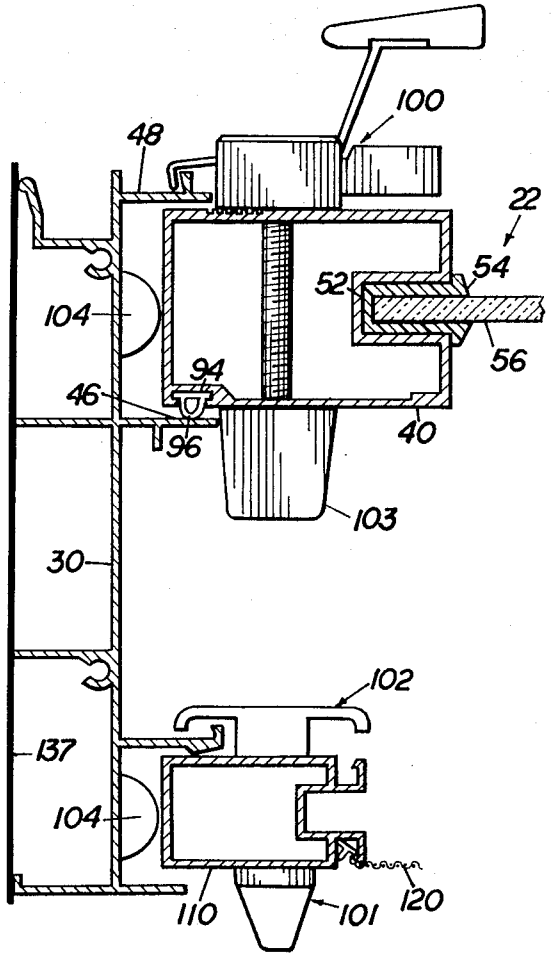
FIG. 13 is a sectional view taken along line 13—13 of FIG. 4.

Turning to FIGS. 13, 14 and 15, other structural features of the present invention include a conventional latch structure generally indicated as 100 affixed to the interior surface of the side rail 40 of panel 22. Similarly, a latch member 102, again which is conventional, is affixed to side rail 110 of the screen 120. Similarly, an outside pull 103 may serve to operate the latch member 100. Weather strip 96 mounted within channel 94 on the side rail 40 engages surface 46 for obvious reasons. An end bumper 104 limits the inward movement of the side rail 40 into the jamb 30 when the movable panel 22 is being closed. Similarly, a bumper structure 104 is positioned relative to the closed position of the side rail 110 of the screen 120 as also shown. Side wall or wall surfacing 137 is secured to the jamb 30 on both ends of the door assembly as shown in FIGS. 13 and 15. With reference to FIG. 14, the interlocking rails 50 of each panel 20 and 22 are shown brought into their interlocking engagement with one another wherein appropriately positioned flanges 97 and 98 of each mating portion of each interlocking rail 50 are disposed in their overlapping relation as clearly shown. Side rail 112 serve to secure the opposite longitudinal edge of screen 120 and position it relative to the outer surface of rail 50 of panel 20. Channel 94 holds a weather strip 96 which engages the outer surface of the interlocking rail 50 wherein the oppositely disposed channel 94 is vacant.

With reference to FIG. 15, another structural feature of the present invention includes the inclusion of a receiving or support channel 48 integrally formed along the interior portion of each jamb 30. This channel 38 extends along the length of the jamb and is specifically configured and dimensioned to receive a wall surfacing product 49 such as dry wall or the like. This provides direct and effectively integral attachment of the wall surfacing 49 to the jamb or the door assembly.

A bumper 105 again limits the movement of the rail 50 towards the jamb 30 when disposed in its open position. The open position of course is defined by allowing access through the doorway in which the panels 20 and 22 are mounted and such open configuration is defined by panel 20 being disposed in substantially parallel overlapping relation to the panel 22. Side rail 40 of the stationary panel 20 is shown being permanently affixed to the jamb 30 by connecting screw 41 passing through the outwardly extending flange 42. Similarly, outwardly extending flange 44 is in cooperative relationship to the outer serragated surface of the side rail 40 as also clearly shown in FIG. 15.

What is claimed is:

1. A sliding door assembly of the type including at least a stationary panel and a movable panel, said door assembly comprising:

(a) a track assembly extending across a doorway and formed at least in part from extruded material and disposed in supporting relation to said panels, (b) both said stationary and movable panels comprising an interlocking rail defining a lateral peripheral portion of each panel, (c) said interlocking rails correspondingly configured and including a mating portion each of which is disposed in substantially mating engagement with one another when said panels are disposed in a closed position along the length of said track assembly, (d) each mating portion comprising two flange elements spaced outwardly from a remainder of said respective interlocking rail and in offset, noncoplanar, spaced apart relation to one another, said two flange element of each interlocking rail extending outwardly in a common direction, (e) said flange element of each interlocking rail being reversely oriented and disposed in parallel, substantially overlapping relation to correspondingly disposed flange elements of the other of said interlocking rails when said panels are disposed in said closed position, (f) a lock assembly mounted on one of said interlocking rails and including a rod element rotatable about its own longitudinal axis and including a distal end portion transversly oriented relative to a length of said rod element and rotatable therewith, (g) said rod element extending into said one interlocking rail in substantially underlying relation to one flange element thereof, said distal end dimensioned and disposed for selective positioning into and out of blocking engagement with a correspondingly positioned and overlapping flange of the other of said interlocking rails, when said panels are in said closed position, upon rotation of said rod element, and whereby relative movement between said panels out of said closed position is prevented when said distal end is in said blocking position.

2. A sliding door assembly as in claim 1 wherein said track assembly comprises a threshold portion having an elongated configuration and being disposed to extend from an edge of said stationary panel along a length of said track assembly to substantially the opposite end thereof, said threshold portion mounted substantially in a middle portion of said track assembly between opposite longitudinal peripheral edges thereof and extending parallel to said movable panel, said threshold portion including depending fingers being integrally formed along the length of opposite peripheral edges of said threshold portion and being flexible relative to the remainder of said threshold portion, said finger structured for snap-lock and removable attachment to said track assembly.

3. A sliding door assembly as in claim 2 wherein said track assembly comprises an elongated channel extending from an edge of said stationary panel to the opposite end of said track assembly, said channel including a flange mounted on each of two inner wall surfaces and extending inwardly therefrom towards a center of said channel, said threshold portion removably mounted within said channel and said depending fingers disposed in removable and substantially fitted engagement with respective ones of said inwardly directed flanges.

4. A sliding door assembly as in claim 1 wherein said track assembly comprises a threshold portion disposed to extend from an edge of said stationary panel along a length of the track assembly to substantially the opposite end thereof, said threshold portion including oppositely disposed depending fingers flexibly attached in spaced apart relation to the remainder of said threshold portion, said fingers structured for a snap-lock and removable attachment to said track assembly.

5. A sliding door assembly as in claim 1 wherein said track assembly includes a track runner mounted thereon and disposed to extend along a length of said track assembly in supporting relation to said movable panel, a roller assembly attached to the undersurface of said movable panel and movably engaging the upper peripheral edge of said track runner, whereby said movable panel is slidable along said track assembly supported on said track runner.

6. A sliding door assembly as in claim 5 wherein said track runner protrudes upwardly from said track assembly and comprises flexibly structured and secured sidewall portions configured for snap-lock and removable attachment along a length of said track assembly.

7. A sliding door assembly as in claim 1 further comprising jamb means formed from an extruded material and disposed to define a peripheral supporting component for remaining portions of said door assembly and including a mounting channel integrally formed on said jamb means and disposed and configured for mounting dry wall material therein, said mounting channel extending along a predetermined length of said jamb means, whereby wall structure of a dwelling in which said door assembly is mounted may be secured directly to integral portions of said door assembly.

* * * * *